US005509156A

United States Patent [19]

Smith

[11] Patent Number: 5,509,156

[45] Date of Patent: Apr. 23, 1996

[54] FOOT BLANKET

[76] Inventor: Billy W. Smith, 40 Bullards Rest. Hwy 76 E., Fair Bluff, N.C. 28439

[21] Appl. No.: 420,015

[22] Filed: Apr. 11, 1995

[51] Int. Cl.[6] ..... A47G 9/02

[52] U.S. Cl. ..... 5/482; 5/485

[58] Field of Search ..... 5/485, 482, 495–502, 5/658

[56] References Cited

U.S. PATENT DOCUMENTS

| | | | |
|---|---|---|---|
| 175,252 | 3/1876 | Milwain | 5/485 |
| 1,863,256 | 6/1932 | Snoddy | 5/494 |
| 2,577,178 | 12/1951 | Bellinger | 5/485 |
| 2,695,414 | 11/1954 | Ford et al. | 5/497 |
| 3,521,309 | 7/1970 | Evans | 5/494 |
| 4,308,626 | 1/1982 | Weiss | 5/485 |
| 4,627,123 | 12/1986 | Uggerud | 5/485 |
| 5,189,744 | 3/1993 | Roberts | 5/497 |

FOREIGN PATENT DOCUMENTS

| | | | |
|---|---|---|---|
| 2145330 | 3/1985 | United Kingdom | 5/499 |

*Primary Examiner*—Alexander Grosz
*Attorney, Agent, or Firm*—Joseph T. Guy, Jr.

[57] ABSTRACT

A blanket for use at the foot of the bed is described. The inventive blanket encases the foot end of the bed and allows the occupant of the bed to place their feet under the bed or on top of the bed. A particularly preferred embodiment comprises a matching top and bottom sheet with an elastic side sheet which allows the proper amount of stretch to insure comfort without destroying the visual appeal of a dressed bed.

7 Claims, 3 Drawing Sheets

FOOT BLANKET

BACKGROUND OF THE INVENTION

This invention is generally related to a blanket which can be used on the foot of a bed. More specifically this invention is related to a blanket which can cover the feet of one occupant while allowing the other occupants feet to remain uncovered.

A well known problem among persons who share a bed is the differences in opinion which arise from the amount of covers required during the night. This problem is especially realized at the foot of the bed where some people prefer that the feet be covered and others prefer that the feet remain outside of the covers. It is common for a compromise to be reached wherein neither person is completely satisfied. One experiences the feeling of cold feet and the other experiences the feeling of hot feet. Typically, the amount of covers desired for the feet differs from the amount desired for the upper legs and torso which is also a bother. It is not atypical for a couple sharing a bed to have a separate blanket covering just the foot end of the bed. One of the individuals may have to fold the cover back to provide a cooler environment. The excess covers require extra effort to redress the bed in the morning which is undesirable. A cover for the feet which can be used in different manners by two individuals in the same bed has been a long standing desire.

A modified bed covering is provided in U.S. Pat. No. 2,577,178 wherein a pocket is provided for increasing the amount of room for the feet. This does not eliminate the basic problem described above and requires a sheet to be cut and modified.

A baby blanket is provided by Snoddy in U.S. Pat. No. 1,863,256 which completely encompasses the baby yet this is restrictive and concern arises over the ability of the baby to move freely under the blanket.

Provided herein is an inventive blanket for use at the foot of a bed wherein one person can keep their feet under the blanket and the other person can keep their feet from being covered.

SUMMARY OF THE INVENTION

It is an object of the present invention to provide a blanket which can be used to cover the feet of a person in bed.

It is a further object to provide a blanket which can cover the feet of an individual and yet still lie flat when the bed is not in use.

It is yet a further object of the present invention to provide a blanket which can cover the feet of one individual in a bed without covering the other individuals feet.

A particular feature of the present invention is provided by the elastic side sheets which allow for a foot blanket which is comfortable in use and aesthetically pleasing when not in use.

These and other features, which will be apparent from the description herein, are provided in a blanket for encasing a foot end of a mattress comprising: a pair of matching rectangular sheets each comprising a foot end, a first side and a second side; a first elastic side sheet attached to said first side of each said matching rectangular sheets; a second elastic side sheet attached to said second side of each said matching rectangular sheets; an elastic foot sheet attached to said foot end of each said matching rectangular sheets.

Another embodiment is provided in a foot blanket for encasing the foot end of a mattress comprising:

a rectangular top sheet, a rectangular bottom sheet and an elastic sheet attached to three sides of said top sheet and said bottom sheet wherein said top sheet, said bottom sheet and said side sheet form an envelope for receiving said foot end of said mattress therein.

A particularly preferred embodiment is provided in a blanket for encasing the foot end of a mattress comprising:

a rectangular top sheet with a width of at least 30 inches and no more than 85 inches; and a length of no more than 30 inches;

a rectangular bottom sheet with a width and length of at least 30 inches and no more than 85 inches and a length of no more than 30 inches; an elastic side sheet attached to three sides of said top sheet and three sides of said bottom sheet.

DETAILED DESCRIPTION OF THE INVENTION

Figure 1:
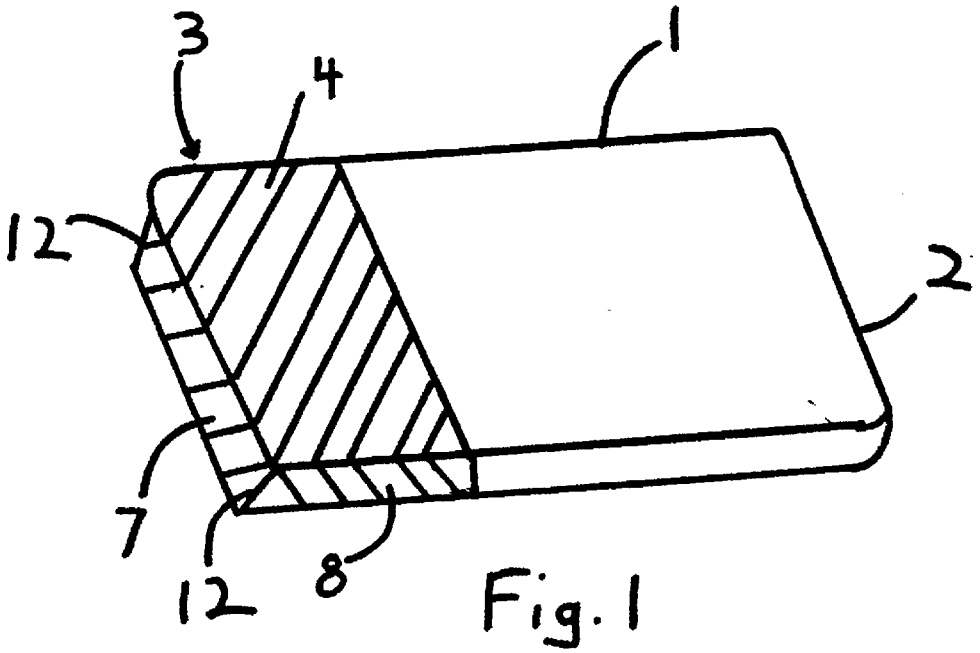
FIG. 1 is a view of the inventive foot blanket with a mattress inserted therein.
Figure 2:
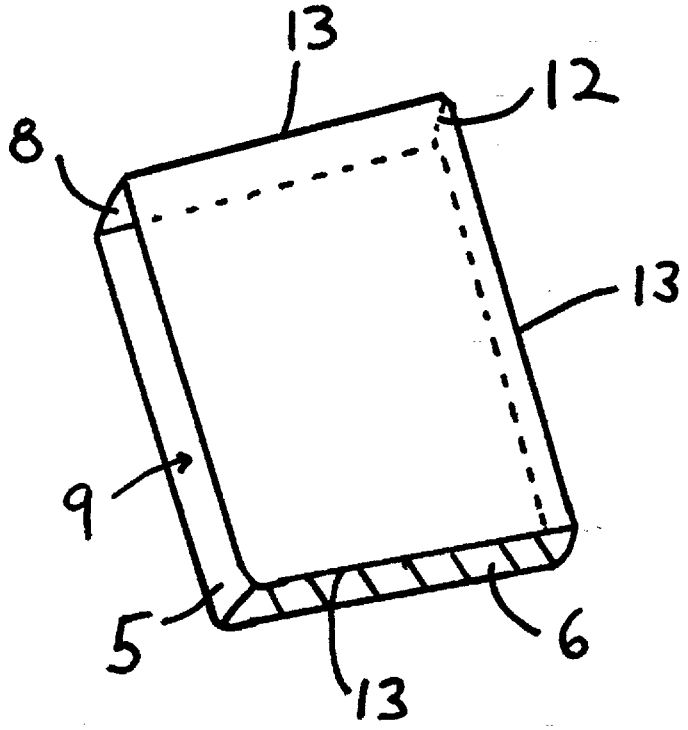
FIG. 2 is a perspective view of the inventive foot blanket without a mattress.

FIG. 1 illustrates a perspective view of the inventive foot blanket as it is used with a mattress. FIG. 2 is a view of the foot blanket with the mattress removed. The mattress, show generally at 1, comprises a head end, 2, at which the head of the individuals sleeping in the bed will lie. The foot end is opposite the head end. The foot blanket, shown at 3, encases the foot end of the bed as illustrated. The foot blanket comprises a top sheet, 4, and a bottom sheet, 5. The top sheet and bottom sheet match with regards to shape and size and sandwich the mattress there between. Three of the edges of the top sheet are attached to side sheets at seams, 13. Two of the side sheets are elastic side sheets, represented by 6 and 8, and one side sheet is an elastic foot sheet, 7. The elastic side sheets, 6 and 8, and elastic foot sheet, 7, may be three separate pieces joined at corner seams, 12, or they may be a single piece wherein the seam, 12, is instead a corner in the elastic sheet. The bottom sheet, 5, and side sheets are either attached at seams or are constructed of a single piece of material. The top sheet, bottom sheet, and side sheets, form an envelope with an open end, 9, within which the foot end of the mattress is received.

Figure 3:
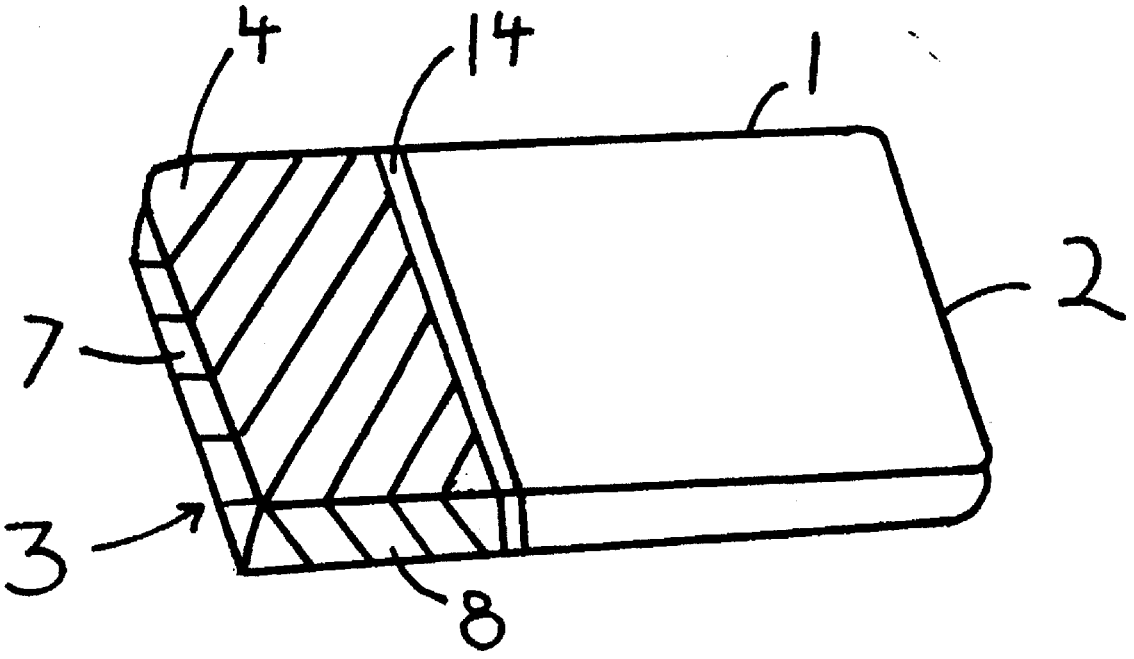
FIG. 3 is a view of a preferred embodiment of the inventive foot blanket.

FIG. 3 is a preferred embodiment of the present invention. In FIG. 3 the mattress, 1, and head end, 2, are as described previously for FIGS. 1 and 2. The foot blanket, 3, comprises a continuous band, 14, attached to the top sheet, bottom sheet and side sheets at the open end of the foot blanket. The continuous band is capable of stretching such that the stretch potential of the foot blanket is at least 6 inches and no more than 15 inches. The continuous band is preferably at least 1 inch wide and no more than 6 inches wide.

Figure 4:
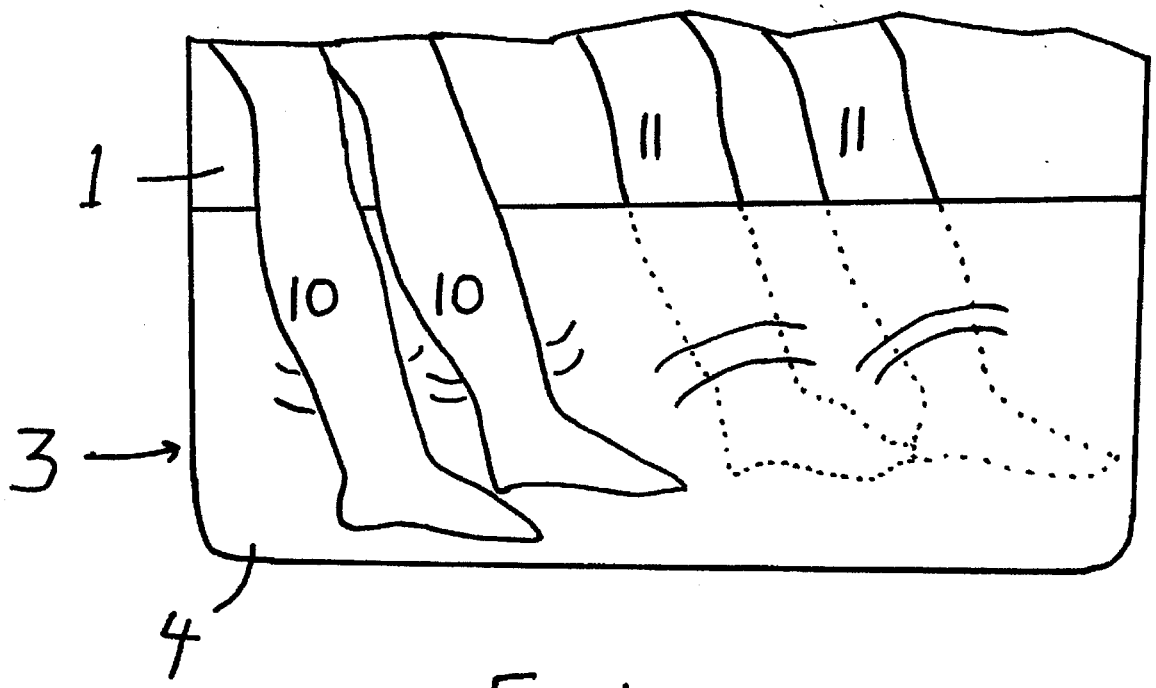
FIG. 4 is a partial view illustrating the utility and advantage offered by the inventive foot blanket wherein one occupant of the bed can have their feet under the blanket for warmth and the other occupant can have their feet over the blanket.

FIG. 4 is a partial view of the inventive foot blanket illustrating the utility. In FIG. 4 the mattress, 1, is received in the foot blanket, 3. One occupant of the bed has chosen to keep the feet, 10, outside the top sheet, 4. One occupant of the bed has chosen to place the feet, 11, under the top sheet, 4. The stretech potential of the foot blanket is chosen to insure that the foot blanket does not bunch up, or have overfolds, which would be a nuisance to the occupant choosing to keep the feet outside of the foot blanket. It would be apparent from the description that either, or both, of the occupants could change one or both feet with ease.

The width of the foot blanket, as measured from side to side, is limited to the size of commercially available mattresses and is preferably at least 30 inches and not more than 85 inches wide. The width is preferably chosen to be suitable for use with one of a single bed, also referred to as a twin bed, a double bed, a queen size bed or a king size bed. For use with a single bed the preferred width is no less than 30 inches wide and no more than 42 inches wide. Preferably, a foot blanket for use with a single bed is no less than 38 inches wide and no more than 40 inches wide. For use with a double bed the preferred width is no less than 50 inches wide and no more than 57 inches wide. Preferably, a foot blanket for use with a double bed is no less than 53 inches wide and no more than 55 inches wide. For use with a queen size bed the preferred width is no less than 58 inches wide and no more than 65 inches wide. Preferably, a foot blanket for use with a queen size bed is no less than 59 inches wide and no more than 61 inches wide. For use with a king size bed the preferred width is no less than 68 inches wide and no more than 80 inches wide. Preferably, a foot blanket for use with a king size bed is no less than 74 inches wide and no more than 78 inches wide.

The length of the foot blanket, as measured from foot end to open end is chosen for comfort. If the foot blanket extends beyond the occupants knees the comfort decreases and the amount of leg movement required to pull the feet out from under the foot blanket, or to place the feet under the foot blanket, is excessive. Preferably, the length of the foot blanket is chosen such that it reaches approximately seventy-five percent of the distance from the occupants foot to the knee. Preferably, the length of the foot blanket is no less than about 8 inches and no more than about 30 inches. More preferably, the length of the foot blanket is no less than about 12 inches and no more than 24 inches. Most preferred is a foot blanket with a length of no less than 16 inches and no more than 20 inches.

The side sheets, bottom sheet and continuous band work in concert to serve several functions including improving the comfort of the foot blanket and maintaining the visual appeal of the bed when not in use. The tautness of the sheet is controlled, predominantly, by either the side sheets and bottom sheet or by the continuous band. If the tautness is to low the top sheet tends to bunch-up or form over folds around the since the top sheet is not pulled tight when released. This is visually distracting when the bed is dressed and is undesirable. If the tautness is to high it is to difficult to stretch the foot blanket away from the mattress and the occupants have a difficult time getting their feet under the foot blanket. Excessive tautness also causes and the foot blanket to be uncomfortable since it places pressure on the occupants feet. The appropriate tautness of the foot blanket is determined by the stretch potential which is defined as the distance the approximate middle of the top sheet can be lifted without indenting the mattress. The approximate middle of the top sheet is preferably able to be lifted at least 6 inches and no more than 15 inches prior to the mattress being indented on the edge. Therefore, the stretch potential is preferably at least 6 inches and no more than 15 inches. If the center of the top sheet can be lifted more than 15 inches without indenting the mattress the foot blanket will be to loose and will not lie flat when not in use. This is aesthetically displeasing since a well dressed bed is difficult to obtain when the foot blanket has wrinkles or overfolds. If the center of the sheet can not be lifted 6 inches without indenting the mattress the foot blanket is to taught and is either difficult for a person to get their feet under or is uncomfortable.

The side sheets preferably have a length which is substantially identical to the top and bottom sheet to which they are attached. For example, two side sheets are preferably as long as the top and bottom sheet and one side sheet preferably has a length which is substantially the same as the width of the top and bottom sheet. The width of the side sheets, as measured from the top sheet to the bottom sheet, depends on the ability of the side sheets to stretch. Preferably, the side sheets are at least 2 inches wide and no more than 14 inches wide.

The material of construction for the top sheet is not limiting with the exception of being limited to materials which are commonly used for making blankets and bed linings. Specifically preferred are natural fibers such as cotton, wool and silk or synthetic materials such as polyester and nylon. Blends are also known to be useful and are suitable for use herein. Blends of cotton and polyester are particularly preferred. The bottom sheet can be constructed of the same material as the top sheet or the same material as the side sheets. Elastic material is readily available from most common material vendors.

The top sheet and bottom sheet can be joined together with the side sheets at seams as common in the art for joining fabrics. Specifically suitable for forming seams are sewing, gluing and the like.

The preferred embodiments are shown and described herein. It would be apparent that other adaptations and modifications can be made without departing from the scope of the invention as set forth in the claims.

I claim:

1. A foot blanket for encasing a foot end of a mattress comprising:

top and bottom, matching rectangular sheets each comprising a foot end, a first side and a second side;

a first elastic side sheet attached to said first side of each said matching rectangular sheet;

a second elastic side sheet attached to said second side of each said matching rectangular sheet;

an elastic foot sheet attached to said foot end of each said matching rectangular sheet, said blanket having a width of at least 30 inches and no more than 85 inches, said blanket having a length of at least 8 inches and no more than 30 inches, said foot blanket having a stretch potential of at least 6 inches and no more than 15 inches, whereby the top sheet is adapted to cover the feet of a user resting on a mattress on an end of which the foot blanket is installed.

2. The blanket of claim 1 wherein said first elastic side sheet, said second elastic side sheet and said elastic foot sheet are one piece.

3. The blanket of claim 1 wherein said width is chosen from a set consisting of:

a) at least 30 inches and no more than 42 inches;

b) at least 50 inches and no more than 57 inches;

c) at least 58 inches and no more than 65 inches; and d) at least 68 inches and no more than 80 inches.

4. The blanket of claim 3 wherein said width is chosen from a set consisting of:

a) at least 38 inches and no more than 40 inches;

b) at least 53 inches and no more than 55 inches;

c) at least 59 inches and no more than 61 inches; and d) at least 74 inches and no more than 78 inches.

5. The blanket of claim 1 wherein said blanket has a length of at least 12 inches and no more than 24 inches.

6. The blanket of claim 5 wherein said blanket has a length of at least 16 inches and no more than 20 inches.

7. The blanket of claim 1 wherein said first side sheet, said second side sheet or said elastic foot sheet is at least 2 inches wide and no more than 14 inches wide.

* * * * *